US007717164B2

(12) United States Patent
Richter

(10) Patent No.: US 7,717,164 B2
(45) Date of Patent: May 18, 2010

(54) STACKED PLATE HEAT EXCHANGER IN PARTICULAR AN OIL COOLER FOR MOTOR VEHICLES

(75) Inventor: Jens Richter, Grossbottwar (DE)

(73) Assignee: BEHR GmbH & Co. KG, Stuttgart (DE)

( * ) Notice: Subject to any disclaimer, the term of this patent is extended or adjusted under 35 U.S.C. 154(b) by 946 days.

(21) Appl. No.: 10/575,906

(22) PCT Filed: Sep. 10, 2004

(86) PCT No.: PCT/EP2004/010152

§ 371 (c)(1),
(2), (4) Date: Aug. 15, 2006

(87) PCT Pub. No.: WO2005/038377

PCT Pub. Date: Apr. 28, 2005

(65) Prior Publication Data

US 2007/0023175 A1 Feb. 1, 2007

(30) Foreign Application Priority Data

Oct. 17, 2003 (DE) ..... 103 49 141

(51) Int. Cl.
*F28F 3/08* (2006.01)

(52) U.S. Cl. ..... 165/167; 165/916

(58) Field of Classification Search ..... 165/153, 165/167, 916

See application file for complete search history.

(56) References Cited

U.S. PATENT DOCUMENTS

| | | | | |
|---|---|---|---|---|
| 4,775,006 | A * | 10/1988 | Hesse | 165/150 |
| 5,464,056 | A * | 11/1995 | Tajima et al. | 165/167 |
| 5,511,612 | A * | 4/1996 | Tajima et al. | 165/167 |
| 5,927,394 | A | 7/1999 | Mendler et al. | |
| 5,931,219 | A | 8/1999 | Kull et al. | |
| 5,950,589 | A * | 9/1999 | Armbruster | 165/916 |
| 6,142,221 | A * | 11/2000 | Johansson | 165/167 |
| 6,182,746 | B1 | 2/2001 | Wiese | |
| 2002/0129926 | A1 * | 9/2002 | Yamaguchi | 165/916 |
| 2003/0106679 | A1 * | 6/2003 | Brost et al. | 165/154 |
| 2003/0164233 | A1 | 9/2003 | Wu et al. | |

FOREIGN PATENT DOCUMENTS

| | | | |
|---|---|---|---|
| DE | 43 14 808 | A1 | 11/1994 |
| DE | 195 11 991 | A1 | 10/1996 |
| DE | 197 11 258 | A1 | 9/1998 |
| DE | 197 50 748 | A1 | 7/1999 |
| DE | 198 05 439 | B4 | 8/1999 |
| EP | 742418 | A2 * | 11/1996 |
| EP | 1 094 291 | A2 | 4/2001 |
| EP | 1 231 447 | A2 | 8/2002 |
| JP | 04356690 | A * | 12/1992 |
| WO | WO 00/46563 | A1 | 8/2000 |
| WO | WO 03/091647 | A1 | 11/2003 |

* cited by examiner

*Primary Examiner*—Leonard R Leo
(74) *Attorney, Agent, or Firm*—Foley & Lardner LLP

(57) ABSTRACT

The invention relates to a stacked plate heat exchanger (1), in particular, an oil cooler for motor vehicles, made up into an assembly from alternating dished plates and baffle sheets (3), stacked one on top of and inside the other, each comprising first and second through openings (7, 8), for the formation of distribution and collector channels, which are welded together to form said first and second flow channels, whereby the baffle sheets (3) form a stay between the stacked plates and the assembly is enclosed by a base plate (4) and a cover plate (5).

5 Claims, 2 Drawing Sheets

STACKED PLATE HEAT EXCHANGER IN PARTICULAR AN OIL COOLER FOR MOTOR VEHICLES

Figure 1:
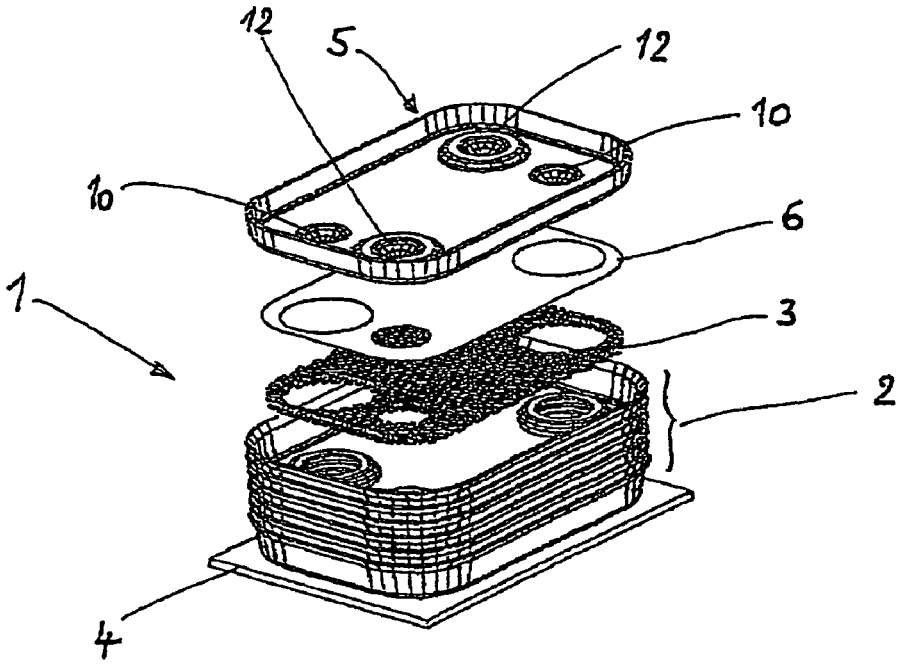

The invention relates to a stacked plate heat exchanger, in particular an oil cooler for motor vehicles, in particular according to the preamble of patent claim 1.

Stacked plate heat exchangers, in particular oil/coolant coolers for internal combustion engines of motor vehicles, are known from various documents of the applicant, for example from DE-A 43 14 808, DE-A 195 11 991 or DE-A 197 50 748. The stacked plate heat exchangers, also called plate heat exchangers, comprise a multiplicity of trough-shaped stacking plates, and if appropriate turbulence inserts, which are placed into one another and stacked to form a block. The stacking plates are usually rectangular in shape—though circular stacking plates are also known—with four passage openings, two for each flow medium, which are arranged in the corner regions of the stacking plates. The stacking plates form flow ducts together with the turbulence inserts, while the passage openings form distribution or collection ducts which are connected either to the first or to the second flow medium. The two different flow ducts, that is to say the different flow media, are partitioned by virtue of the fact that two of the passage openings are in each case arranged in a raised annular stamped formation which is soldered to the adjacent stacking plate which is planar in this region. The turbulence inserts both increase the heat transfer capacity, in particular that of oil, and serve as a tie rod against the inner pressure which builds up during operation and can be approximately 6 to 10 bar in oil coolers. Stacked plate heat exchangers for cooling exhaust gas or charge air are also known, for example from DE-A 195 11 991 cited above.

The outermost, that is to say the upper and the lower flow ducts constitute a problem when dimensioning the stacked plate heat exchangers, since they are considered the weakest link with regard to the inner pressure loading. While there is pressure equalization in the case of the inwardly situated flow ducts, this is not the case for the outer flow ducts. In addition, in the region of the passage openings, the tie rod action of the metal turbulence plates is adversely affected on account of the cut shape of the metal turbulence plates and the stamped formations in the stacking plates, so that the full inner pressure resistance is not obtained here. To solve this problem, the upper and lower closing plates have been provided with a relatively large wall thickness or—as described in DE-A 197 11 258—with a strengthening plate between the lowest stacking plate and a base plate. Strengthening plates of this type or increased wall thicknesses lead to additional weight and to increased costs.

It is an object of the present invention to improve a stacked plate heat exchanger of the type mentioned in the introduction with regard to its strength, in particular its inner pressure resistance, without significantly increasing the weight.

This object is achieved by means of the features of patent claim 1. According to the invention, a thin intermediate metal plate is inserted between the uppermost turbulence insert and the cover plate, which intermediate metal plate has the cut shape and the hole pattern of the turbulence insert and is soldered to the latter and to the cover plate. This brings about the advantage that, in the region of the passage openings or of the distribution or collection ducts in particular, higher inner pressure resistance is obtained in the region of said openings. The uppermost turbulence insert is soldered at its upper side to the intermediate metal plate, and the intermediate metal plate is advantageously also soldered to the cover plate, producing a tie rod action which results in an increase in strength.

In a further embodiment of the invention, the cover plate has a stamped formation in the region of the passage openings in a concentric arrangement, which stamped formation is directed outward in such a way that a hollow space in the form of an annular gap is produced between the intermediate metal plate and the cover plate. This annular gap gives rise to pressure equalization on the intermediate metal plate in the circumferential region of the passage opening. This results in the advantage of increased inner pressure resistance, in particular in the region of the passage openings. On account of its low wall thickness of a few tenths of a millimeter, the intermediate metal plate practically constitutes an almost weight-neutral measure for increasing the strength of the stacked plate heat exchanger.

Further solutions according to the invention are presented by claim 7.

Figure 5:
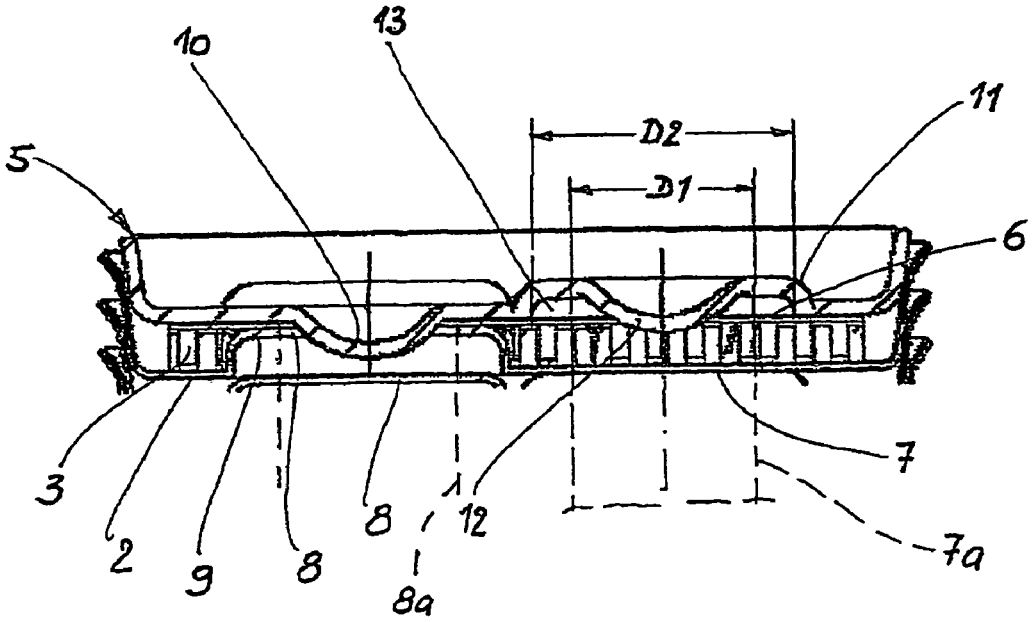
Figure 2:
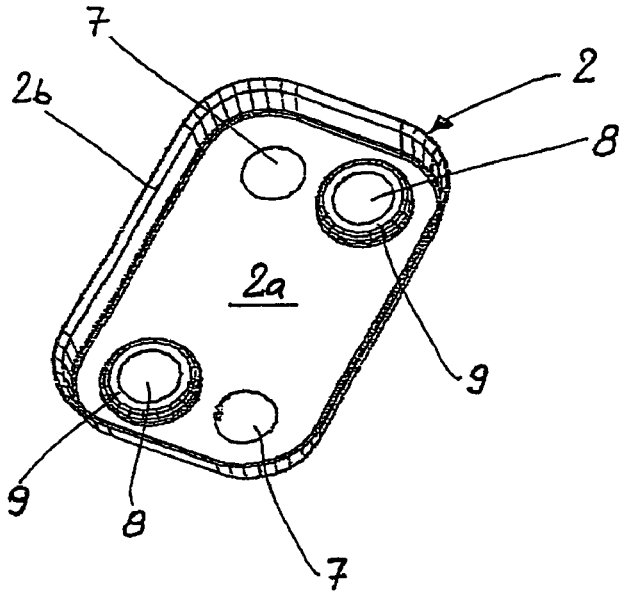
Figure 3:
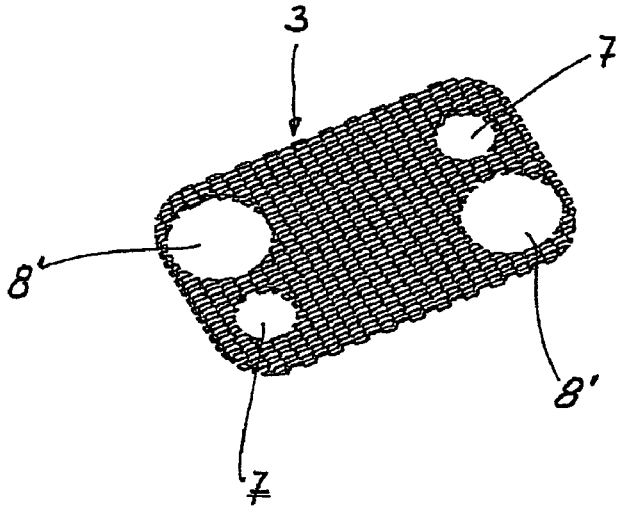
Figure 4:
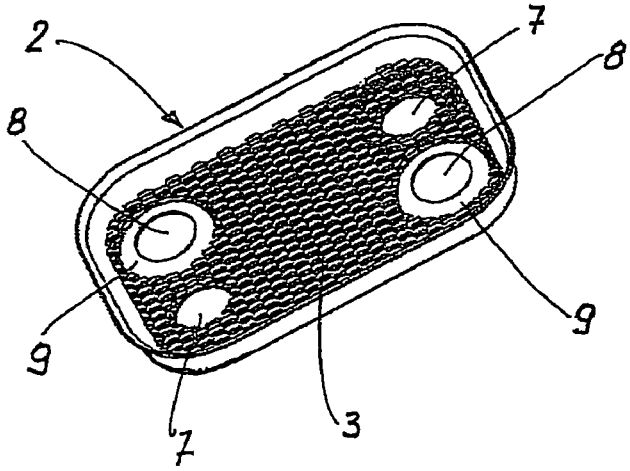

One exemplary embodiment of the invention is described in more detail in the following and is illustrated in the drawing, in which:

FIG. 1 shows the construction of a stacked plate oil cooler in a partially exploded illustration, FIG. 2 shows one stacking plate of the stacked plate oil cooler from FIG. 1, FIG. 3 shows a metal turbulence plate, FIG. 4 shows the metal turbulence plate from FIG. 3 inserted into the stacking plate from FIG. 2 and FIG. 5 shows a cross-section through the uppermost part of the stacked plate oil cooler having an intermediate metal plate.

FIG. 1 shows the construction of a stacked plate oil cooler 1 which is constructed from a multiplicity of stacking plates 2 and metal turbulence plates 3 (turbulence inserts) arranged between said stacking plates 2. The stacked plate oil cooler 1 is closed off by means of a base plate 4 and a cover plate 5. An intermediate metal plate 6, which is described in more detail in conjunction with the description of FIG. 5, is inserted between the uppermost metal turbulence plate 3 and the cover plate 5. Connections for the oil and a liquid coolant are arranged in the base plate 4, but cannot be seen or are not illustrated—they correspond to the prior art cited in the introduction. In contrast, the cover plate 5 is closed; it has, as is described later, stamped impressions 10, 12.

FIG. 2 shows one of the stacking plates 2 which is trough-shaped and has a substantially planar base 2*a*, a continuously encircling raised edge 2*b*, first passage openings 7 and second passage openings 8 which are each arranged in the corner regions of the approximately rectangular stacking plate 2. While the first passage openings 7 are arranged in the plane of the base 2*a*, the second passage openings 8 are raised relative to the base 2*a* and are arranged in an annular stamped formation 9. When stacked and soldered on top of one another, the first passage openings 7 and the second passage openings 8 form distribution and collection ducts (7*a*, 8*a*, cf. FIG. 5) for the first flow medium, for example engine oil of an internal combustion engine of a motor vehicle, and the second flow medium, for example the coolant of a cooling circuit (not illustrated) of the internal combustion engine.

FIG. 3 shows one of the turbulence inserts 3 which is inserted into the stacking plate 2 and therefore has the same outer cut shape and the same hole pattern with first passage openings 7 and second passage openings 8' which correspond in diameter to the annular stamped formations 9 and are therefore larger than the passage openings 8. The metal turbulence plate 3 is known from the prior art and serves to improve the heat transfer, in particular on the oil side, and to increase the inner pressure resistance by means of a tie rod effect.

FIG. 4 shows the stacking plate 2 with the metal turbulence plate 3 inserted, the upper side of the annular stamped formations 9 being uncovered. Further stacking plates and metal turbulence plates are stacked on top of one another in an alternating fashion on said stacking plate 2 with the metal turbulence plate 3 inserted, as a result of which flow ducts for the oil and the coolant are formed in an alternating fashion, which flow ducts are separated from one another by means of the soldering of the stacking plates.

FIG. 4 shows a flow duct, which is covered at the top, for the medium oil, the oil flowing into the flow duct via one of the two passage openings 7, passing through said flow duct approximately diagonally through the metal turbulence plate 3, and flowing out again via the other passage opening 7 which is situated diametrically opposite. The oil flow duct is covered by a stacking plate (not illustrated) which has annular stamped formations in the region of the first passage openings 7 and is flat in the region of the passage openings 8, so that soldering is carried out in the region of the annular face 9.

FIG. 5. shows a cross-section through the uppermost region of the stacked plate oil cooler from FIG. 1, identical reference signs being used for identical parts. The section passes transversely through the two front passage openings 8, 7 which are arranged one above the other and form a distribution or collection duct 8*a* for the coolant and a distribution or collection duct 7*a* for the oil. Of the entire stack, only the uppermost stacking plate 2 is illustrated completely, which uppermost stacking plate 2 has the annular stamped formation 9 in the region of the passage opening 8. The passage opening 7 is arranged, at the right-hand side of the stacking plate 2 in the drawing, in the planar base region 2*a*, that is to say offset in height relative to the passage opening 8. A metal turbulence plate 3 is placed on the base region 2*a*, which metal turbulence plate 3 has the cutout 8' in the region of the stamped formation 9 and has the cutout 7 (cf. FIG. 3) in the region of the passage opening 7. The intermediate metal plate 6 (cf. FIG. 1) is arranged above the metal turbulence plate 3 and has the same hole pattern as the stacking plate 2. Said intermediate metal plate 3 is relatively thin and has, for example, a wall thickness of from 0.1 to 0.5 mm, inclusive of solder plating at each side. The cover plate 5, which closes off the stacked plate oil cooler 1 at the top, is placed onto the intermediate metal plate 6, the cover plate 5 being closed in this exemplary embodiment, that is to say it closes off all the first and second passage openings 7, 8 (four in total). The cover plate 5, intermediate metal plate 6, metal turbulence plate 3 and the uppermost stacking plate 2 are soldered to one another at their contact points. In the region of the passage openings 8, the cover plate 5 has spherical-cap-like inwardly directed stamped impressions 10 which project into the distribution collection ducts 8*a*. In the region of the passage openings 7, the cover plate 5 has outwardly directed stamped formations 11 which each have a spherical-cap-like, inwardly directed stamped impression 12 in their central region. The distribution or collection duct 7*a* has a diameter D1 and extends through the metal turbulence plate 3 and the intermediate metal plate 6. A hollow space in the form of an annular gap 13 is formed between the stamped formation 11 and the intermediate metal plate 6, which hollow space has an outer diameter D2 which is larger than the diameter D1 of the distribution or collection duct 7*a*, approximately 10 mm larger. The annular gap 13 communicates with the duct 7*a*, as a result of which pressure equalization with the adjacent oil flow duct (not illustrated) is produced. The intermediate metal plate 6 is therefore relieved of load in the region of the annular face between the diameters D2-D1. The pressure forces arising from the inner pressure are guided directly into the closing plate 5 outside the diameter region D2 via the combination of the soldered metal turbulence plate 3 and the intermediate metal plate 6. The metal turbulence plate 3 therefore acts in conjunction with the intermediate metal plate 6 as a sandwich component with relatively high pressure resistance and bending strength.

The invention claimed is:

1. A stacked plate heat exchanger for motor vehicles, comprising:

trough-shaped stacking plates; and metal turbulence plates, wherein the trough-shaped stacking plates and the metal turbulence plates are stacked onto and into one another in an alternating fashion to form a block and each have first and second passage openings for forming distribution and collection ducts and are soldered to one another to form first and second flow ducts, wherein the metal turbulence plates forming tie rods between the stacking plates and the block are closed off by a base plate and a cover plate, wherein a thin intermediate metal plate, which has the hole pattern of the metal turbulence plate, is arranged between the uppermost metal turbulence plate and the cover plate and is soldered both to the metal turbulence plate and to the cover plate, wherein the stacking plates each have a substantially planar face and annular stamped formations, wherein the first passage openings are arranged in the substantially planar face and the second passage openings are arranged, such that they are raised, in the annular stamped formations and are at least partially closed off outwardly by means of the cover plate, wherein an outwardly directed stamped formation is arranged in the cover plate concentrically with respect to the first passage openings, and wherein an annular gap is left between the stamped formation and the thin intermediate metal plate.

2. The stacked plate heat exchanger as claimed in claim 1, wherein the cover plate is soldered to the intermediate metal plate in the region of the second passage openings.

3. The stacked plate heat exchanger as claimed in claim 1, wherein the intermediate metal plate has a wall thickness of from 0.1 to 0.5 mm and is solder-plated at each side.

4. The stacked plate heat exchanger as claimed in claim 1, wherein the passage openings have an inner diameter and the stamped formation has an inner diameter being approximately 10 mm larger than.

5. The stacked plate heat exchanger as claimed in claim 1, wherein the cover plate has concentric, spherical-cap-shaped stamped impressions in the region of the passage openings.

* * * * *